US005687503A

United States Patent [19]

D'Costa

[11] Patent Number: 5,687,503

[45] Date of Patent: Nov. 18, 1997

[54] VASE

[76] Inventor: Vernon Leslie D'Costa, 7 Saltmarsh Lane, Hayling Island, Hampshire P011 0JT, United Kingdom

[21] Appl. No.: 537,698

[22] PCT Filed: Apr. 25, 1994

[86] PCT No.: PCT/GB94/00876

§ 371 Date: Oct. 27, 1995

§ 102(e) Date: Oct. 27, 1995

[87] PCT Pub. No.: WO94/25375

PCT Pub. Date: Nov. 10, 1994

[30] Foreign Application Priority Data

Apr. 27, 1993 [GB] United Kingdom ..... 9308692

[51] Int. Cl.[6] ..... A01G 5/00; A47G 7/00

[52] U.S. Cl. ..... 47/41.01; 229/162; 229/199

[58] Field of Search ..... 47/84 C, 72, 41.01; 229/162, 199, 117.05, 3.1

[56] References Cited

U.S. PATENT DOCUMENTS

| | | | |
|---|---|---|---|
| 2,416,725 | 3/1947 | Williamson | 229/162 |
| 4,069,917 | 1/1978 | Stollberg et al. | 47/84 C |
| 4,209,092 | 6/1980 | Jones | 47/84 C |
| 4,662,107 | 5/1987 | Van Den Kieboom | 47/72 |
| 5,038,930 | 8/1991 | Holtkamp, Jr. | 229/162 |

FOREIGN PATENT DOCUMENTS

| | | | |
|---|---|---|---|
| 572652 | 3/1956 | Italy | 47/66 B |
| 891078 | 3/1962 | United Kingdom | 47/84 C |
| 88/00006 | 1/1988 | WIPO | 47/72 |

*Primary Examiner*—Terry Lee Melius
*Assistant Examiner*—Joanne C. Downs
*Attorney, Agent, or Firm*—Ware, Fressola, Van Der Sluys & Adolphson LLP

[57] ABSTRACT

An erectable flower vase of waterproof sheet material comprises a base (3) and walls (4, 5, 6, 7), which are substantially flat when erected, and an apertured stiffening member (8) which is arrangeable within the mouth (2) of the erected base to hold the mouth open and through which the stem of flowers supported in the vase can extend.

18 Claims, 3 Drawing Sheets

VASE

TECHNICAL FIELD

The present invention relates to an erectable vase.

BACKGROUND OF THE INVENTION

The popularity of sending flowers, particularly via telephone orders to networks of florists, has increased. When such flowers are delivered to the recipient away from home, in an office or hospital for example, there is often difficulty in finding a suitable vase for the flowers.

SUMMARY OF THE INVENTION

The object of the present invention is to provide an improved vase.

According to the invention there is provided a flower vase of waterproof sheet material, which is erectable from a collapsed state, the vase comprising:

a base and walls, which are substantially flat when erected, and an apertured stiffening member which is arrangeable within the mouth of the erected vase to hold the mouth open and through which the stems of flowers supported in the vase can extend.

In accordance with a preferred feature of the invention, the apertured stiffening member is set at between 5% and 10% of the height of the vase below the top of the vase when erected. At this height, the stiffening member serves to stabilize the stems of flowers arranged in the vase, so that the flowers form a stable arrangement.

Preferably, the stiffening member has edges each provided with a flange for holding the stiffening member flat when in use holding the mouth of the vase open. Conveniently, one of the flanges of the stiffening member attaches the latter to one of the walls of the vase; and the flange of the stiffening member opposite from the attached one is adapted to be connected to the wall opposite from the attached-to wall, and this former wall is complementarily adapted. The said adaption can consist of a slot along a line of connection of the said opposite flange to the stiffening member and a tongue cut in the said opposite wall, the tongue engaging in the slot in use of the vase to connect the said flange to the said wall.

In the preferred embodiment, the vase has four walls, prior to use two being non-folded and two being folded along their middle to lie between the flat walls, the base being similarly folded and arranged. The stiffening member is attached to one of the non-folded flat walls.

Preferably, the vase includes a detachable greetings card. The greetings card can comprise extensions of the walls of the vase other than the one to which the stiffening member is attached, the greetings card being connected to these walls at perforated lines prior to its detachment.

To help understanding of the invention, a specific embodiment thereof will be described by way of example and with reference to the accompanying drawings, in which.

BEST MODE FOR CARRYING OUT THE INVENTION

Figure 1:
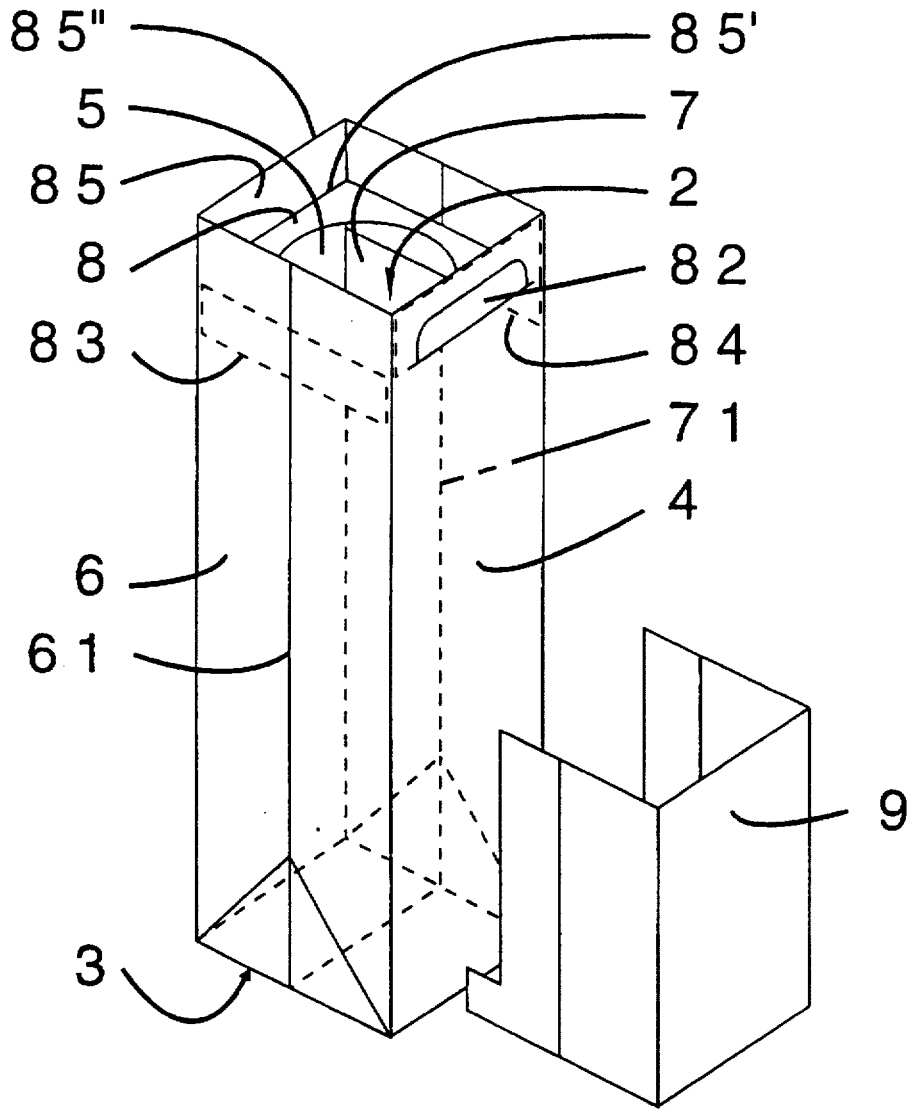
FIG. 1 is a perspective view of a vase of the invention in its erected state.

The erectable vase shown in the drawings is produced from a single sheet 1 of waterproof card, cut, pre-creased, folded and glued to form a mouth 2, a base 3, a front wall 4 and a back wall 5, and a pair of side walls 6,7. An apertured stiffening member 8 lies within the mouth 2. A tab 41 at one side of the front wall 4 enables the front wall to be glued to the side wall 7.

Figure 3:
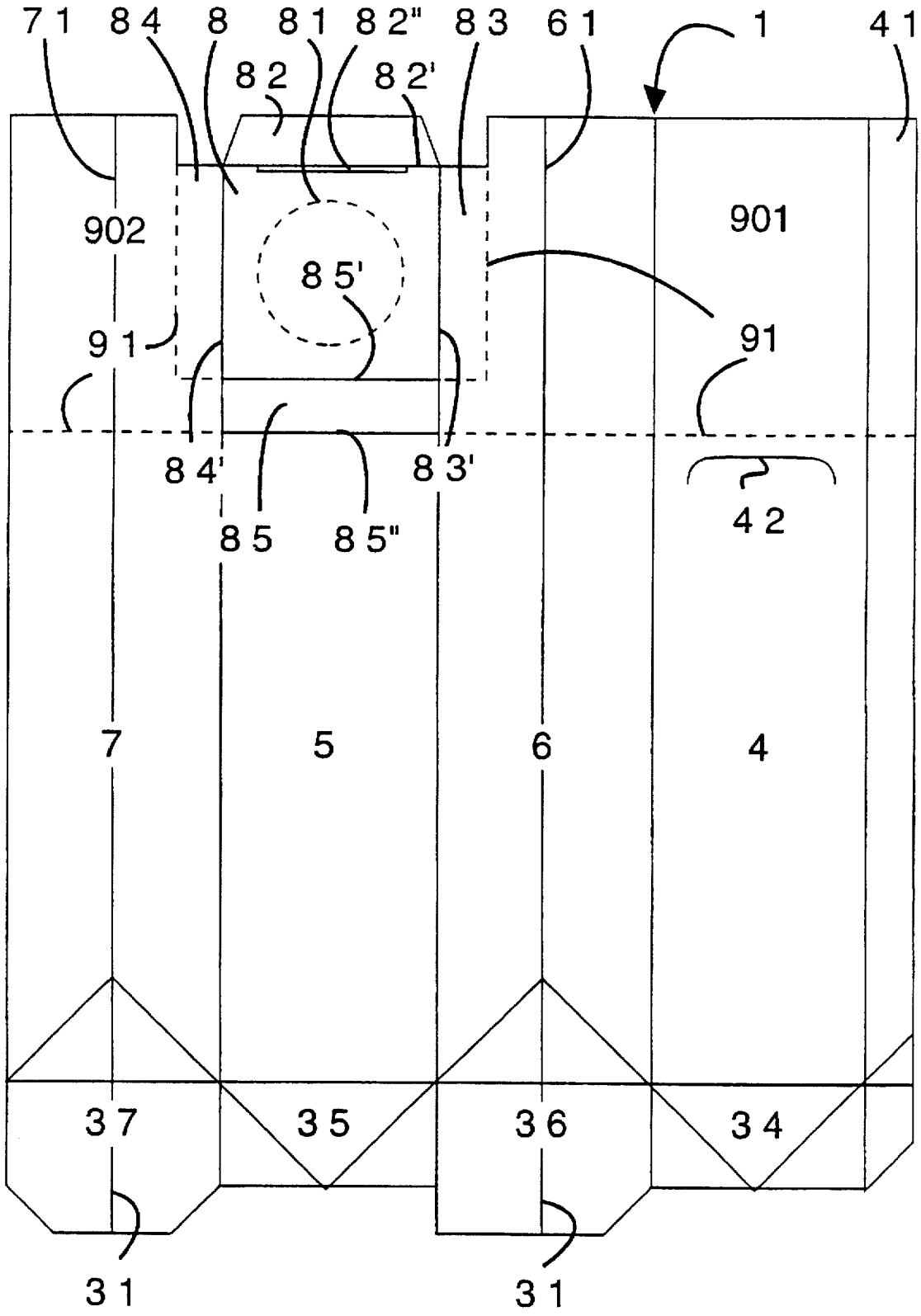
FIG. 3 is plan view of a cut sheet before assembly to form the of FIG. 1.
Figure 4:
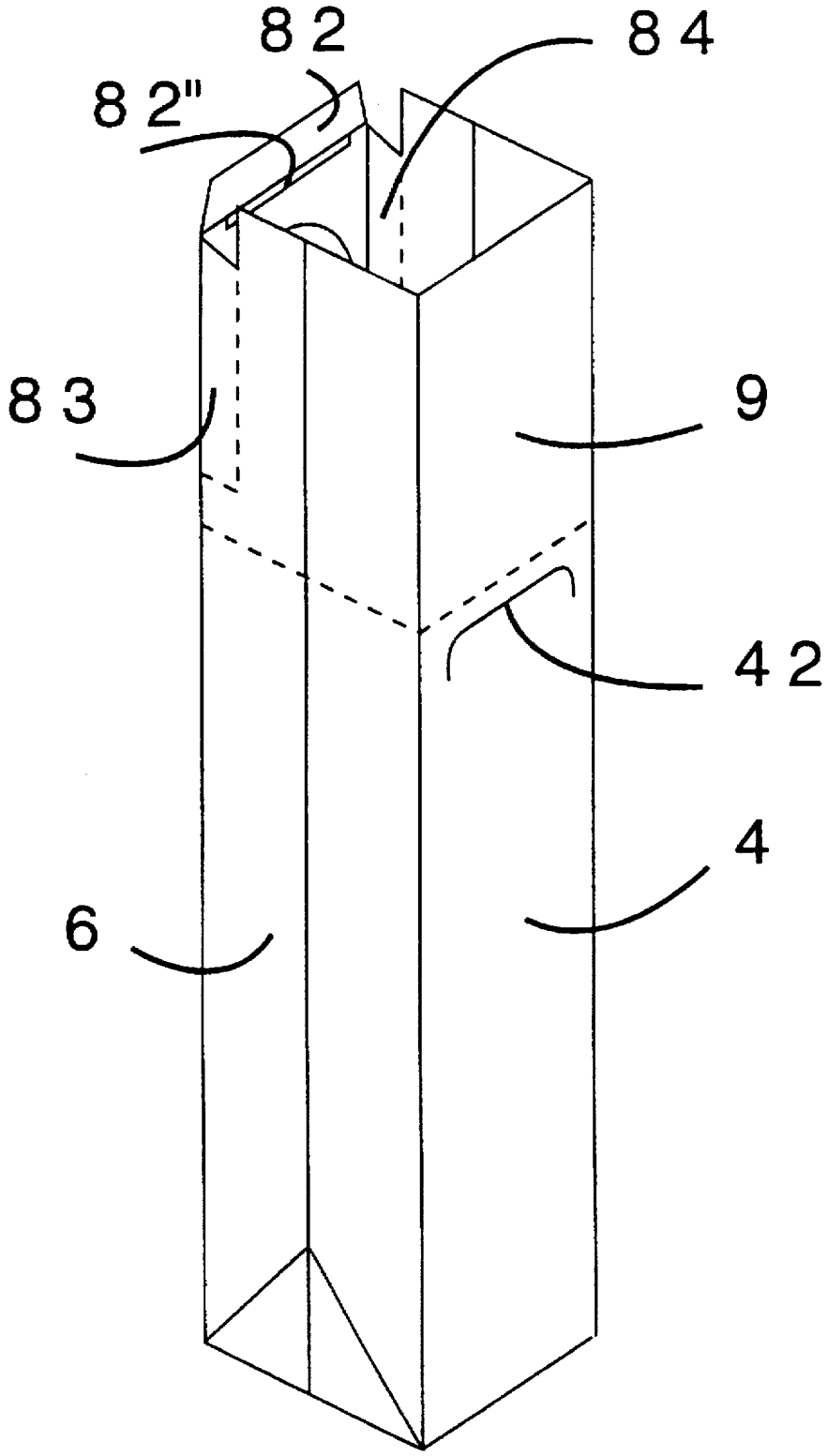
FIG. 4 is a view similar to FIG. 1 of the vase during erection, with its greetings card ready for removal and its stiffening member ready for folding down into the mouth of the vase.

As shown in FIG. 3, the base 3 is made up of four base flaps 34,35,36 and 37, which are respectively joined to the bottom edge of the front wall 4, the back wall 5, and the side walls 6,7. The flaps are conventionally cut and creased for gluing together to form a water tight collapsible base. In so far as the base details as such are conventional, within the capabilities of the man skilled in the art and form no part of the present invention, they will not be further described herein.

Figure 2:
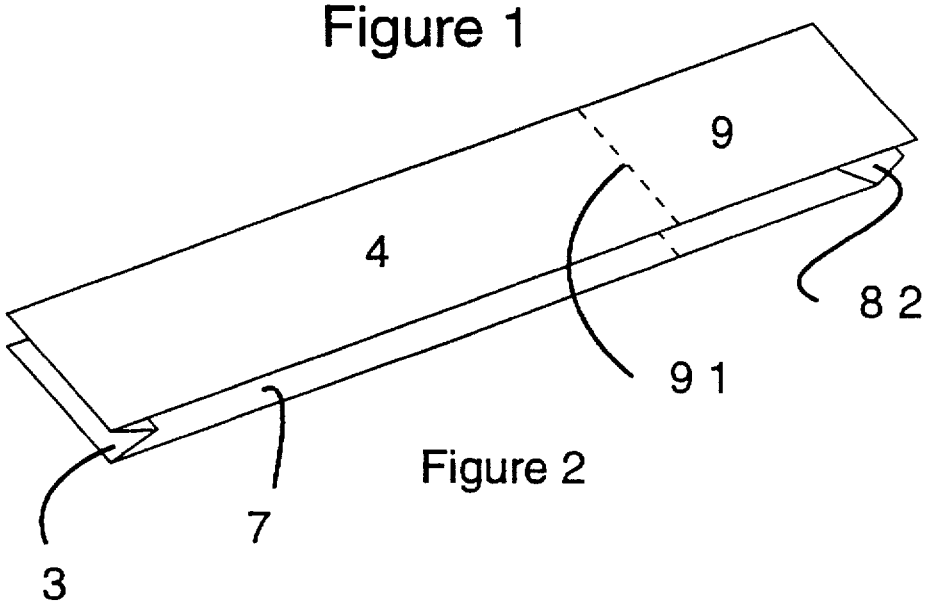
FIG. 2 is a perspective view of the vase of FIG. 1 in its collapsed state ready for erection.

After assembly and gluing, the vase is collapsed to its state shown in FIG. 2. For this the side walls are creased at 61,71 and the base is creased at 31.

For use, the vase is opened out to the erect state as as shown in FIG. 1.

The stiffening member 8 has a circular, apertured cutout 81 for flower stems and integral marginal flanges of its card 82, 83, 84, 85 for holding the member flat in use. These are connected to the stiffening member 8 at respective creases 82', 83', 84', 85'. In the collapsed state of the vase—FIG. 2—the stiffening member 8 and the flanges 82,85 are an extension of the back wall 5, whilst the flanges 83,84 are partial extensions of the side walls 6,7.

On erection of the vase, the stiffening member is folded into the mouth of the vase. The edge marginal flanges 83, 84 extend inwards along the side walls and stiffen the stiffening member in the direction in which the vase tends to collapse due to its side creases 61,71 tending to revert to their collapsed condition. The free end marginal flange 82 engages with a tongue 42 partially cut from the front wall 4, via a slit 82" at its crease 82'. The connected end marginal flange 85 is connected to the back wall 5 of the vase at further crease 85". When the vase has been erected, the stiffening member 8 is tucked into the top end of the erected vase, with the connected marginal flange 85 extending down at the top of the back wall and the free end marginal flange 82 extending up inside the front wall 4—engaged with the tongue 42.

The preferred vase has a square, 70 mm×70 mm base and a height of 185 mm in its erected state as shown in FIG. 1. The stiffening member is set down from the top of the vase by 15 mm, that is the height of the flange 85. The diameter of the aperture 81 is 50 mm. This configuration provides a stable arrangement of flowers supported in the vase. The height of the stiffening member in the vase is important. At the above height—or approximately so—the stiffening member holds the stalks for the stable arrangement and for this reason is also referred to as a "stalk stabilizer".

The stiffening member has a greetings card piece 9 initially connected to it at perforations 91. The greetings card is united from two card portions 901,902, when the vase is glued up along tab 41. Further, the greetings card is formed as extensions of the front wall 4 and the side walls 6,7, to the three of which it is connected by the perforations 91. Tearing along the perforations allows the stiffening member to be folded to its use position. At the same time, the greeting card can be stood at the foot of the vase as shown in FIG. 1.

I claim:

1. A collapsible flower vase of waterproof sheet material, comprising:

a base forming a closed bottom of the vase and a plurality of walls cut from a sheet of the waterproof sheet material and watertightly joined together to form the vase, the base and the walls being interconnected by watertight folds and glued together to form a watertight seal, the vase when in an erected state having an open mouth at the end opposite the base, two of the walls and the base having watertight creases, the creases being flattenable and the folds being openable on erection of the vase from a collapsed, substantially flat state to an erected state, an apertured stiffening member which is arrangeable within the open mouth of the vase when the vase is erected, the apertured stiffening member to hold the open mouth open, the apertured stiffening member forming an opening through which the stems of the flowers supported in the vase can extend;

the waterproof sheet material remaining waterproof not only in the walls and the base, but also at the folds and at the creases, during initial construction of the vase, during collapse of the vase at the creases and folds and during erection of the vase, whereby the vase is unlined.

2. A vase as claimed in claim 1, wherein the apertured stiffening member is set at between 5% and 10% of a height of the vase below the open mouth of the vase when erected.

3. A vase as claimed in claim 2, wherein the apertured stiffening member has edges each provided with a flange for holding the apertured stiffening member flat, when in use holding the open mouth of the vase open.

4. A vase as claimed in claim 3, wherein a first flange of the apertured stiffening member attaches the apertured stiffening member to a first wall of vase.

5. A vase as claimed in claim 4, wherein a second flange of the apertured stiffening member opposite from the first flange and attached to the first wall is adapted to be connected to a second wall opposite from the first wall, and the second wall being complementarily adapted.

6. A vase as claimed in claim 5, wherein the adaptation of the second flange consist of a slot along a line of connection of the second flange of the apertured stiffening member and a tongue cut in the second wall, the tongue engaging in the slot during erection of the vase to connect the second flange to the second wall.

7. A vase as claimed in claim 1, wherein the apertured stiffening member has edges, each edge having a flange for holding the apertured stiffening member flat, when in use holding the open mouth of the vase open.

8. A vase as claimed in claim 7, wherein a first flange of the apertured stiffening member attaches the apertured stiffening member to a first wall of the vase.

9. A vase as claimed in claim 8, wherein a second flange of the apertured stiffening member opposite from the first flange attached to the first wall is adapted to be connected to a second wall opposite from the first wall, the second wall being complementarily adapted.

10. A vase as claimed in claim 9, wherein the adaptation of the second flange consists of a slot along a line of connection of the second flange of the apertured stiffening member and a tongue cut in the second wall, the tongue engaging in the slot during erection of the vase to connect the second flange to the second wall.

11. A vase as claimed in claim 10, wherein the vase has four walls, prior to erection of the vase, two walls being non-folded and two walls being folded along a middle line of the walls, the folds being positioned between the non-folded walls upon erection of the vase, the base being similarly folded.

12. A vase as claimed in claim 11, wherein the apertured stiffening member is attached to one of the non-folded walls.

13. A vase as claimed in claim 1, wherein the vase has four walls, prior to erection of the vase, two walls being non-folded and two walls being folded along a middle line of the walls, the folds being positioned between the non-folded walls upon erection of the vase, the base being similarly folded.

14. A vase as claimed in claim 13, wherein a flange of the apertured stiffening member attaches the apertured stiffening member to one of the walls of the vase and wherein the apertured stiffening member is attached to one of the non-folded walls.

15. A vase as claimed in claim 14, including a detachable greetings card.

16. A vase as claimed in claim 1, including a detachable greeting card.

17. A vase as claimed in claim 16, wherein a flange of the apertured stiffening member attaches the apertured stiffening member to one of the walls of the vase and wherein the greetings card comprises extensions of the walls of the vase other than the wall to which the apertured stiffening member is attached, the greetings card being connected to the walls at perforated lines prior to detachment of the greetings card.

18. A vase as claimed in claim 1, wherein the waterproof sheet material of the vase is waterproof card.

* * * * *